United States Patent [19]

O'Brien et al.

[11] 4,212,529

[45] Jul. 15, 1980

[54] APPARATUS FOR PRODUCING DUPLEX COPIES

[75] Inventors: Robert J. O'Brien, Rochester; Walter A. Stryjewski, Hilton, both of N.Y.

[73] Assignee: Eastman Kodak Company, Rochester, N.Y.

[21] Appl. No.: 959,126

[22] Filed: Nov. 6, 1978

[51] Int. Cl.[2] ..... G03G 15/00

[52] U.S. Cl. ..... 355/3 R; 271/186; 355/3 SH; 355/24

[58] Field of Search ..... 355/3 R, 24, 26, 3 SH; 271/65, 186, DIG. 9

[56] References Cited

U.S. PATENT DOCUMENTS

| | | | |
|---|---|---|---|
| 2,177,787 | 10/1939 | Root | 271/186 |
| 3,773,319 | 11/1973 | Hottendorf et al. | 271/186 X |
| 4,095,979 | 6/1978 | DiFrancesco et al. | 355/26 X |

*Primary Examiner*—Fred L. Braun

*Attorney, Agent, or Firm*—William F. Noval

[57] ABSTRACT

Apparatus for producing duplex copies and including a movable image receiving member for receiving first and second unfixed transferable images, an image transfer device for transferring the transferable images to the first and second sides of a copy sheet and copy sheet handling apparatus. The copy sheet handling apparatus includes a copy sheet vacuum pick-off member located adjacent to the image receiving member and a mechanism for moving the pick-off member in synchronism with the image receiving member through a closed loop path to initially vacuum contact a copy sheet in contact with the image receiving member after transfer of the first unfixed image to the first side of the copy sheet, to remove and reorient the copy sheet while the first image is unfixed, and to register the second side of the copy sheet with the second transferable image on the image receiving member at the image transfer device.

9 Claims, 3 Drawing Figures

APPARATUS FOR PRODUCING DUPLEX COPIES

BACKGROUND OF THE INVENTION

1. Field of the Invention

This invention relates to apparatus for producing duplex copies. More particularly, this invention relates to apparatus for transferring unfixed transferable images to both sides of a copy sheet before fixing of either image to the copy sheet.

2. Description of the Prior Art

Several techniques are known in the prior art for forming duplex images on a final copy medium such as a web or sheet. One such technique requires the use of two photoconductors upon which first and second transferable images ae formed respectively. The copy medium is generally passed between the photoconductors and the first and second images are transferred to opposite sides of the copy medium. Another technique similar to the above but involving the use of only one photoconductor, utilizes an intermediate image storage member such as a drum, to receive the first image formed on the photoconductor before transfer to a final copy medium. These techniques suffer the disadvantages of increased cost, machine complexity and size and decreased reliability necessitated by the use either of two photoconductive and optical systems or of additional components before transfer to a final copy medium.

A further duplexing technique utilized in certain commercial electrophotographic machines utilizes a "two-pass" process wherein first fixed images developed sequentially on the first sides of a plurality of copy sheets by an electrophotographic process are collected in an intermediate tray and then sequentially transported back through the electrophotographic process to develop second fixed images on the second sides of the copy sheets, thus producing duplex copies. This process is disadvantageous for several reasons. First, duplex copy is not available for inspection until all of the first sides of the copy sheets and one set of the second sides thereof have been developed. In addition, the relatively long paper paths required in passing a copy sheet through the electrophotographic process twice greatly increases the possiblity of paper jams and other potential copy handling complications. Moreover, environmental conditions of image formation and the physical parameters of the copy sheet may change resulting in images of varying quality on opposite sides of a single sheet and misregistration between images on opposite sides of a copy sheet may also result.

Another duplex copying technique involves fixing images to both sides of a copy sheet during a single pass through the disclosed electrophotographic processes. U.S. Pat. Nos. 3,506,347; 3,672,765; 3,869,202; and 3,947,270 disclose various embodiments of this technique. In the first patent just listed a first tackified image is formed on a transfer drum, the image is transferred to the first side of a copy sheet, and the sheet is inverted while the first tackified image dries and becomes fixed on the copy sheet. Thereafter, a second tackified copy image is formed on the transfer drum and the copy sheet is fed back into contact with the drum to transfer the second image to the second side of the copy sheet which is then transported to an output tray. In the latter three patents electrophotographic apparatus is disclosed for making copies wherein two images of an original are formed sequentially on a photoconductor, the images are developed and the first developed image is transferred to the first side of a copy sheet. The copy sheet is passed through a fuser to fuse or fix the first transferred image, is turned over and the opposite side of the copy sheet is brought into contact with the second developed image on the photoconductor. The second image is then transferred to the second side of the copy sheet, the copy sheet separated from the photoconductor and the second image fused by means of a second fuser. The disclosed techniques have several disadvantages. Since the first image is fixed before transfer of the second image, either two fusers must be used with attendant increase in cost, power and environmental heat or solvent fixing is used resulting in safety hazards and the inconvenience of handling consumable liquids.

In Research Disclosure Vol. 156, April, 1977, Item 15671 published by Industrial Opportunities Ltd. in Homewell, Havant, Hampshire, U.K., there is disclosed a single pass duplexing technique wherein unfixed toner images are transferred to opposite sides of a copy sheet before fixing of either image. A reversible vacuum belt inverts the copy sheet after transfer of the first image to the copy sheet.

A further disadvantage of many of the above duplexing techniques is the inability to handle heavy copy sheet stock. Most of these techniques are designed to handle copy sheets which are quite flexible and capable of being transported through relatively sharp paths. Heavier paper and card stock may be relatively inflexible and incapable of easily negotiating such sharp paths.

SUMMARY OF THE INVENTION

The present invention alleviates the above and other disadvantages of prior duplex copiers. According to one feature of the invention a single copying process is provided resulting in decreased cost, size and complexity and increased reliability with no image degradation since no intermediate storage member is used. According to another feature of the invention unfixed images are formed on either one or both sides of a copy sheet before fixing of the images thus eliminating the need for a second fuser with attendant decrease in power usage, environmental heat and cost or for solvent fixing thus eliminating safety hazards and the inconvenience of replenishing liquids. Another feature of the invention reduces the length of the copy path from that required for "two-pass" duplexing thus reducing side to side copy quality variability and misregistration and the incidence of paper jams and increasing the production of a finished duplex copy. The present invention is also able to process relatively heavy and inflexible copy sheets and utilizes a drive which operates unidirectionally thus eliminating the necessity for complex timing and control systems inherent in techniques requiring direction reversal and resultant deceleration and acceleration of operating components. Consequently, system inertia is kept low and system component motion is kept smooth and uncomplicated.

According to the present invention there is provided apparatus for producing duplex copies and including a movable image receiving member for receiving first and second unfixed transferable images, and copy sheet handling means. According to an aspect of the invention, the copy sheet handling means includes a copy sheet vacuum pick-off member located adjacent to the image receiving member and means for moving the pick-off member in synchronism with the image receiving member through a closed loop path (a) to vacuum contact a copy sheet separating from the image receiving member after transfer of the first unfixed image to a first side of the copy sheet, (b) to remove and reorient the copy sheet while the first image is unfixed; and (c) to register a second side of the copy sheet with the second transferable image on the image receiving member.

The invention and its features and advantages will be set forth and become more apparent in the detailed description of the preferred embodiment presented below.

BRIEF DESCRIPTION OF THE DRAWINGS

In the detailed description of the preferred embodiment of the invention presented below reference is made to the accompanying drawings, in which.

DESCRIPTION OF THE PREFERRED EMBODIMENT

Figure 1:
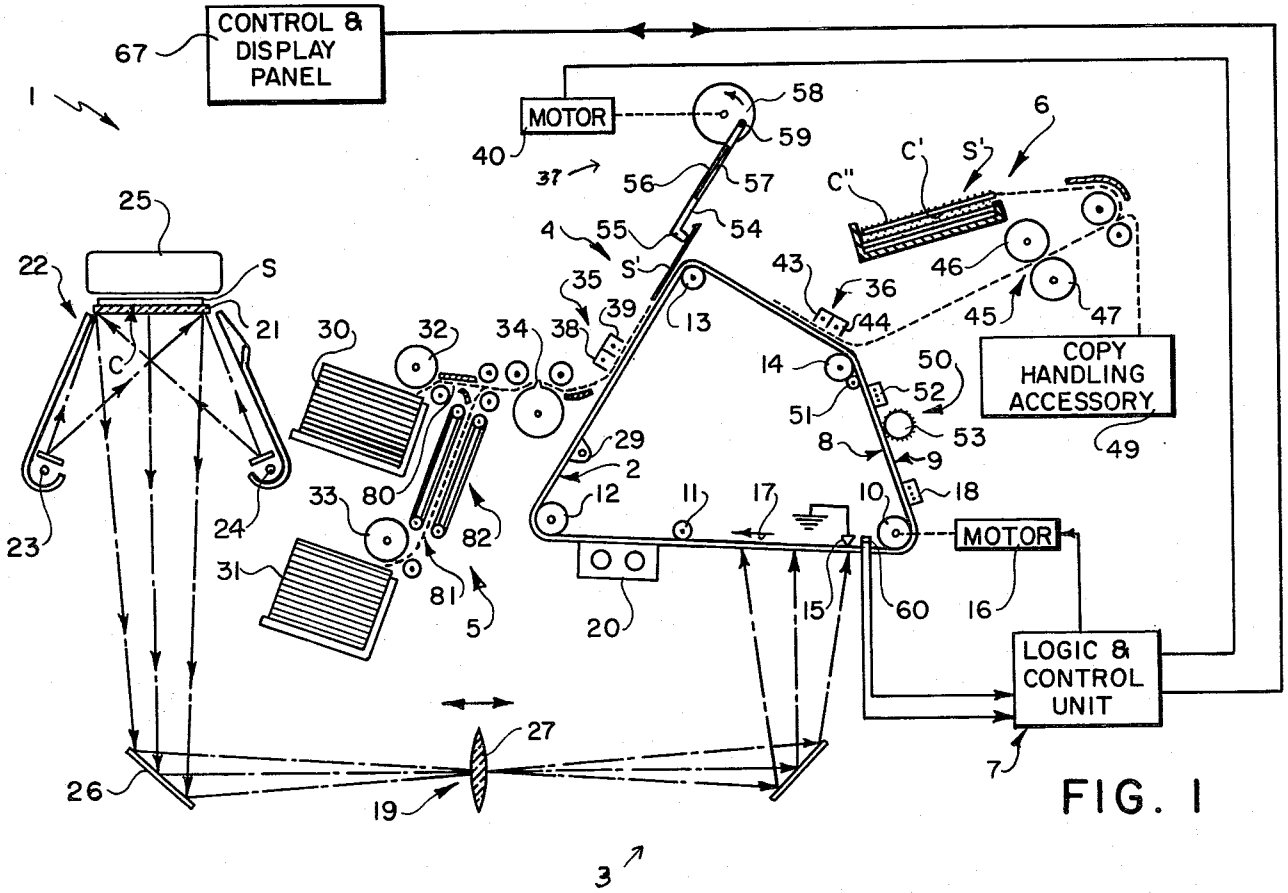
FIG. 1 is a schematic diagram of duplex apparatus incorporating a preferred embodiment of the present invention.

Referrig now to the drawings, there is disclosed apparatus for producing duplex copies incorporating a preferred embodiment of the present invention. In FIG. 1 apparatus 1 is shown as an electrophotographic copier which may include, among other elements, an image receiving member 2, an image forming means 3, a copy sheet duplexing section 4, copy sheet input and output sections 5 and 6, respectively, and a logic and control unit 7. Image forming means 3 forms transferable images on image receiving member 2, copy sheet input section 5 supplies copy sheets, copy sheet duplexing section 4 transfers images from member 2 to a copy sheet, copy sheet output section 6 fixes the images to the copy sheet to produce a final copy and delivers the final copy to an output hopper or to a copy handling accessory and logic and control unit (LCU) 7 coordinates the operation of the various elements of apparatus 1 to produce final copies.

The term "sheet" as used in this application is used in reference to a single expanse of thin essentially flat material such as paper or transparencies having two opposed sides. "Simplex" refers to a sheet having only one side having an image: "duplex" refers to a sheet having images on both sides. A "copy sheet" is a sheet which receives simplex or duplex images.

Image Transfer Member and Image Forming Means

Image receiving member 2 may be any member upon which transferable images may be formed and from which the images may be transferred to a copy sheet. In the preferred form of apparatus shown in FIG. 1, member 2 may incorporate a transparent support 8 and a photoconductor 9 backed by a conductive layer (not shown) grounded by grounding brushes 15 and may be trained about transport rollers 10, 11, 12, 13 and 14. Roller 10 is coupled to a drive motor 16 controlled by LCU 7 to move member 2 in a clockwise direction indicated by arrow 17 past various electrophotographic work stations to be described later in greater detail.

Image forming means 3 includes a charging station 18 at which the photoconductor 9 of member 2 receives a uniform electrostatic charge from a suitable device such as a corona charger; an exposing station 19 at which the image of an original to be copied is projected onto electrostatically charged photoconductor 9 of member 2 thereby dissipating the electrostatic charge at the exposed areas of member 2 to form a latent electrostatic image corresponding to the original image; and a developing station 20 at which developing power including toner particles having an electrostatic charge opposite to that of the latent electrostatic image is brushed over member 2 to develop the latent electrostatic image into a toner image corresponding to the original image.

Charging station 18 is shown as including a corona charger which may for example be a three-wire grid-controlled type which establishes a uniform negative surface potential on member 2. Other types of known charging devices may also be used such as open wire corona chargers or the like.

Exposing station 19 is shown as including a transparent exposure platen 21 upon which originals to be copied are positioned, an illumination source 22 including flash lamps 23 and 24, and projection optics such as mirrors 26 and 28 and lens 27 which may be movably mounted to permit reduced or enlarged image reproduction. A recirculating feeder 25 may be positioned on the top of platen 21 and may for example take the form of that disclosed in U.S. Pat. No. Re.27,976 wherein a plurality of original documents having images on first sides thereof are repeatedly fed in succession from a supply stack to the exposure platen 21 of copier 1.

Feeder 25 places a selected side C of a sheet of an original document S with side C facing platen 21. When energized, flash lamps 23 and 24 illuminate side C of document S to produce a light image of the original image which is projected onto member 2 by mirrors 26, 28 and lens 27 to produce a latent electrostatic image corresponding to the original image.

Development station 20 may include a magnetic brush developer which brushes developer including toner particles having an electrostatic charge opposite to that of the latent electrostatic image over member 2. The toner particles adhere to the latent electrostatic image to form a transferable visible toner image which corresponds to the original image.

A post development erase station 29 including an infrared illumination source may be provided to reduce photoconductor fatigue i.e. electrical stress on the photoconductor which decreases its ability to accept or hold an electrostatic charge.

Copy Sheet Input, Duplexing and Output Sections

Copy sheet input section 5 includes supplies 30 and 31 of copy sheets S' of any suitable material such as paper, transparencies or the like. Copy sheets S' are supplied from the top of either supply 30 or supply 31 by means of oscillating vacuum rollers 32, 33, respectively. When apparatus 1 operates to make duplex copies, copy sheets S' are supplied either from supply 30 along path 80 to registration mechanism 34 or from supply 31 along path 81 by transport belts 82 to registration mechanism 34. In either case mechanism 34 registers the first side of copy sheet S' with the first toned image on member 2 at the first transfer station 35 and synchronizes the movement of copy sheets S' with member 2.

Image forming means 3 forms first and second transferable toner images on member 2. Copy sheet duplexing section 4 is provided to effect transfer of the toner images to copy sheets and includes first and second image transfer stations 35 and 36 and copy sheet handling means 37 located adjacent to member 2 between transfer stations 35 and 36.

First transfer station 35 may include a first transfer corona charger 38 which has a negative DC potential applied to its corona wire and a first detack charger 39 which has an AC potential applied to its corona wire. Registration mechanism 34 registers a copy sheet S' with the first toner image formed on member 2 at first transfer station 35 where first transfer charger 38 impresses a negative charge on sheet S' to cause the positively charged first toner image to be transferred from member 2 to a first side C' of sheet S'. Detack charger 39 neutralizes the negative charge on copy sheet S' so that it can be easily separated from member 2.

Copy sheet handling means 37 includes an elongated vacuum pick-off member 54 having a vacuum segment 55 at one end thereof to vacuum contact the unimaged side of a copy sheet S'. Member 54 is mounted for reciprocatory and rotational movement by means of a fixed pivot 56 disposed in slot 57 of member 54. The other end of member 54 is affixed to cam 57 by driven pivot 59. Cam 58 is rotated in a counterclockwise direction by means of motor 40. As will be described in greater detail hereinafter, vacuum member 54 vacuum contacts a copy sheet as it separates from member 2 at roller 13 inverts the copy sheet while the first image transferred to one side thereof is unfixed and registers the other side of copy sheet S' with the second transferable image on member 2 at second image transfer station 36.

Second transfer station 36 is similar to first transfer station 35 and includes second transfer charger 43 and second detack charger 44. Second transfer charger 43 impresses a negative charge on a sheet S' to transfer a second toner image from member 2 to side C'' of sheet S' and second detack charger 44 neutralizes any charge remaining on sheet S' so that it may be easily separated from member 2.

After transfer of both toner images to sheet S' it is separated from member 2 and directed to output station 6 which includes a fixing means 45 for fixing the unfixed toner images to copy sheet S'. As shown, fixing means 45 may be a roller fuser including heated rollers 46 and 47 for heating and fusing the toner particles to sheet S' to form a final copy. Sheet S' may then be transported to an output tray 48 or to a copy handling accessory 49 such as a device which effects straight or offset stacking and stapling of copy sheets or sets of copy sheets.

A cleaning station 50 is provided to effect mechanical and electrical cleaning of photoconductor 9 of web 2. Station 50 includes a cleaning assist erase lamp 51 which exposes the photoconductor to radiation to reduce more of the charge remaining from the transfer and detack steps; a cleaning assist charger 52 which impresses an AC charge on photoconductive surface 9 of web 2 to neutralize the charges on untransferred toner particles; and a brush 53 which removes any residual toner from surface 9 and deposits it in a suitable collection container (not shown).

Copy Sheet Handling Means

Figure 2:
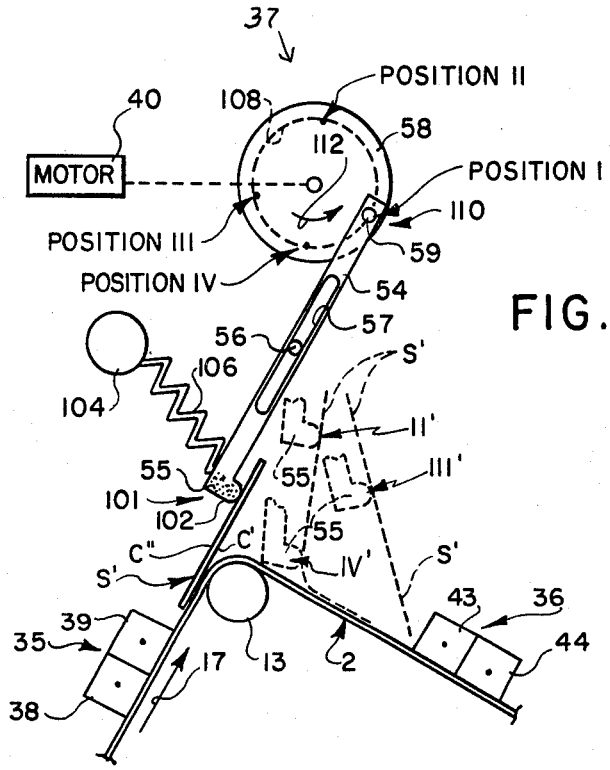
FIG. 2 is a diagrammatic sectional view of the copy duplexing station of the copier of FIG. 1.

Referring now to FIG. 2 there is shown in greater detail copy sheet handling means 37. Means 37 includes a vacuum pick-off member shown as an elongated member 54 having a vacuum segment 55 at one end 101 of member 54 for vacuum contacting a copy sheet S'. Segment 55 includes several vacuum ports 102 connected to a source of vacuum 104 by means of flexible tubing 106. Member 54 is supported for rotational and reciprocating movement by means of a fixed pivot 56 mounted on a suitable structural member of copier 1 (not shown) and disposed in slot 57 of member 54.

Motor 40 moves the other end 110 of member 54 through cam 58 and drive pivot 59 in the direction of arrow 112 in a unidirectional circular path indicated by dashing circle 108 in synchronism with member 2. As shown in FIG. 2, pivot 59 has been moved to a position I causing vacuum segment 55 of member 54 to engage side C'' of sheet S' as it separates from member 2 at roller 13. At position I vacuum source 104 applies a vacuum to ports 102 of segment 55 through tube 106 to draw sheet S' into vacuum contact with segment 55 (Position I'). As pivot 59 is moved along path 108 in the direction of arrow 112 to positions such as II and III, segment 55 is moved to Positions II' and III' to position the second side C'' of sheet S' with respect to the second transferable image on member 2. when pivot 59 is moved to position IV, segment 55 is positioned at IV' and source 104 releases the vacuum applied to ports 102 of segment 55 and transfer charger 43 electrostatically tacks sheet S' to member 2 as it transfers the second image from member 2 to side C''. Thereafter, pivot 59 is returned to position I, and segment 55 to I' where it contacts the next succeeding copy sheet in the same manner.

Since vacuum segment 55 has contacted the unimaged side of copy sheet S', it is reoriented while the first image is unfixed thereby eliminating the necessity for fusing the first image before second side transfer. Moreover, copy sheet reorientation is effected while the second image on member 2 moves past first transfer station 35 so that distances between images can be kept to a minimum.

Although driven pivot 59 is shown moved in a circular path by means of cam 58, it will be understood that pivot 59 could be moved in other path configurations in order to move vacuum segment 55 and consequently copy sheet S' in other path configurations. Thus, cam 58 could be mounted for rotation about a point other than its center to obtain an eccentric movement of driven pivot 59, cam 58 could have a configuration other than circular, driven pivot 59 could be mounted on an endless flexible member trained about suitable supports in any desired configuration, etc.

Member 54 may also take other configurations and be supported for movement by other means than that shown in FIGS. 1 and 2.

Logic and Control Unit

Figure 3:
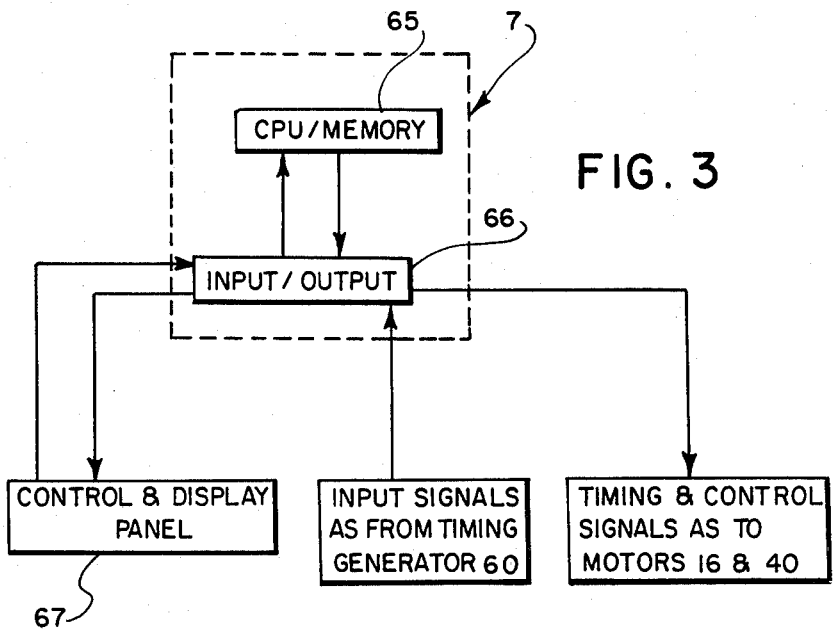
FIG. 3 is a block diagram of the control unit of FIG. 1.

As shown in FIG. 1, and more particularly in FIG. 3, operation of copies 1 and its related accessories such as feeder 25, copy sheet handling means 37 and copy handling accessory 49 is monitored and controlled by a digital microprocessor incorporated in logic and control unit (LCU) and memory module 65 and an input-/output module 66. Module 65 includes a CPU which processes data in digital format, a program memory such as a read only memory (ROM) which stores basic logic and control subroutines and a random access memory (RAM) which is used for temporary memory and for maintaining a short term account of the flow of original documents and of copies being processed. Module 66 provides all of the control signals and data bus connections to communicate with the CPU, ROM and RAM of module 65.

A control and display panel 67 is provided on copier 1 and includes operator selectable switches and controls for such functions as number of copies desired, choice of simplex or duplex copying etc. and also includes displays to indicate information such as number of copies selected, number of copies produced, jam conditions in the copier or its accessories, etc. Input signals to LCU 7 are derived from various switches, sensors and the like which monitor copier operation, track the passage of copy sheets, etc., and from a timing generator 60. As disclosed in U.S. Pat. No. 3,914,047, member 2 may include a series of perforations along an edge thereof which are sensed by a sensor such as a piezoelectric or optic sensor 60. The perforations provide a means of generating timing signals which are related to the movement of member 2 and which are used to synchronize the various mechanisms of copier 1 and its accessories with the location of the images formed on web 2.

Output signals from LCU 7 control the various work stations of the copier including turning drive motor 16 on and off, initiating flash lamps 23 and 24 and controlling motor 40 to effect operation of means 37.

The invention has been described in detail with particular reference to preferred embodiments thereof but it will be understood that variations and modifications can be effected within the spirit and scope of the invention.

What is claimed is:

1. In apparatus for producing duplex copies and including a movable image receiving member for receiving first and second unfixed transferable images, copy sheet handling means comprising;

a copy sheet vacuum pick-off member located adjacent to said image receiving member, said pick-off member having a vacuum region for vacuum contacting a copy sheet;

means for mounting said pick-off member for pivotal and reciprocatory movement; and means for moving said vacuum pick-off member in synchronism with said image-receiving member so that said vacuum region moves through a unidirectional closed loop path (a) to initially vacuum contact the other side of a copy sheet in contact with said image-receiving member and to one side of which a first unfixed image has been transferred, (b) to remove and reorient said copy sheet while said first image is unfixed, and (c) to bring the other side of said copy sheet into transfer relationship with the second transferable image on the image receiving member.

2. The copy sheet handling means of claim 1 wherein said vacuum pick-off member includes an elongated member having an end at which said vacuum region is located.

3. The copy sheet handling means of claim 1 wherein said moving means moves said pick-off member so that said vacuum region moves in a circular path.

4. In electrophotographic apparatus for producing duplex copies and including a movable photoconductive member for receiving first and second unfixed toner images and also including first and second image transfer means for transferring the first and second toner images to the opposite sides of a copy sheet, copy sheet handling means comprising;

a copy sheet vacuum pick-off member located between said first and second image transfer means adjacent to said photoconductive member, said pick-off member having a vacuum region for vacuum contacting a copy sheet;

means for mounting said pick-off member for pivotal and reciprocatory movement; and means for moving said vacuum pick-off member in synchronism with said photoconductive member so that said vacuum region moves through a unidirectional closed loop path (a) to initially contact the other side of a copy sheet in contact with said photoconductive member and to one side of which a first unfixed toner image has been transferred by said first transfer means, (b) to remove and reorient said copy sheet while the first toner image is unfixed, and (c) to bring the other side of said copy sheet into transfer relationship with the second toner image on said photoconductive member at said second image transfer means.

5. The copy sheet handling means of claim 4 wherein said vacuum pick-off member includes an elongated member having an end at which said vacuum region is located.

6. The copy sheet handling means of claim 4 wherein said moving means moves said pick-off member so that said vacuum region moves in a circular path.

7. The copy sheet handling means of claim 4 including copy sheet supply means for supplying a copy sheet into transfer relationship with said first toner image on said photoconductive member.

8. The copy sheet handling means of claim 4 or 7 including fixing means for fixing said toner images to said copy sheet.

9. In apparatus for producing a duplex copy on a copy sheet having an unfixed first image on one side in contact with a movable image receiving member adapted to receive a second image for transfer to the other side of the copy sheet, copy sheet handling means comprising;

a vacuum member located adjacent to said image receiving member for manipulating said copy sheet, said vacuum member having a vacuum region for vacuum contacting said copy sheet;

means for mounting said vacuum member for pivotal and reciprocatory movement; and means for moving said vacuum member in synchronism with said image receiving member so that said vacuum region moves through a unidirectional closed loop path to (a) position the vacuum member in contact with the other side of said copy sheet; (b) remove the copy sheet with its unfixed image from the image receiving member; and (c) position said other side of said copy sheet in image transfer relation to the second image on the image receiving member.

* * * * *